United States Patent [19]

Ideyama

[11] Patent Number: 4,934,314

[45] Date of Patent: Jun. 19, 1990

[54] DEVELOPING APPARATUS PROVIDED WITH TONER REPLENISHING ARRANGEMENT

[75] Inventor: Hiroyuki Ideyama, Osaka, Japan

[73] Assignee: Minolta Camera Kabushiki Kaisha, Osaka, Japan

[21] Appl. No.: 366,325

[22] Filed: Jun. 14, 1989

Related U.S. Application Data

[63] Continuation of Ser. No. 169,010, Mar. 16, 1988, abandoned.

[30] Foreign Application Priority Data

Mar. 17, 1987 [JP] Japan ..... 62-64984

[51] Int. Cl.[5] ..... G03G 15/08

[52] U.S. Cl. ..... 118/689; 355/246

[58] Field of Search ..... 355/246, 245; 118/688-691, 665; 222/DIG. 1

[56] References Cited

U.S. PATENT DOCUMENTS 4,101,214 7/1978 Irie et al. ..... 355/14 D
4,122,981 10/1978 Takeuchi et al. .
4,416,535 11/1983 Tottori .
4,514,480 4/1985 Wada et al. .
4,519,695 5/1985 Murai et al. ..... 355/14 D
4,522,481 6/1985 Imai et al. ..... 355/14 D
4,639,117 1/1987 Murai et al. ..... 355/14 D
4,687,320 8/1987 Nakanishi et al. .
4,708,458 11/1987 Ueda et al. .

FOREIGN PATENT DOCUMENTS 58-190966 11/1983 Japan .

*Primary Examiner*—R. L. Moses
*Attorney, Agent, or Firm*—Burns, Doane, Swecker & Mathis

[57] ABSTRACT

A developing apparatus for use in an electrophotographic system, which is so arranged that concentration of the developing material is maintained constant irrespective of the sizes of the sheets used for recording, and is not varied by the densities of the images to be recorded, while troubles of the apparatus, the state of "toner empty", and troubles of a developing material replenishing device, etc. may be detected without the need for providing sensors exclusive for the purpose.

27 Claims, 3 Drawing Sheets

DEVELOPING APPARATUS PROVIDED WITH TONER REPLENISHING ARRANGEMENT

This application is a continuation of application Ser. No. 169,010, filed Mar. 16, 1988, now abandoned.

BACKGROUND OF THE INVENTION

The present invention generally relates to a developing apparatus for an electrophotographic copying apparatus or the like, and more particularly, to a toner replenishing arrangement for a developing apparatus for use in an electrophotographic copying apparatus, etc.

Commonly, in an electrophotographic copying apparatus, an image of an original document is formed on the surface of a photosensitive member as an electrostatic latent image, onto which toner is caused to adhere so as to form a visible toner image. Then, this toner image is transferred and fixed onto a copy paper, and thus, the image of the original document is reproduced on the copy paper.

In the above processing, since the toner is consumed for each copying, it is necessary to replenish the developing apparatus with toner by a replenishing means provided within the copying apparatus main body, as well as to detect that the toner for the replenishment in the replenishing means has run out to be empty.

As one practice for replenishment of toner, there has been known a constant amount replenishing method. In this practice, a predetermined amount of toner is replenished per each one copy cycle.

Conventionally, since an average toner consumption for one ordinary copy paper sheet may be found by the copy paper size most frequently adopted and an aveage image density during ordinary copying, it has been a usual practice to set the toner replenishing amount equal to such average toner consumption, whereby owing to the fact that the toner consumption becomes equal to the toner replenishing amount in a long term, the toner concentration within the developing aparatus may be stabilized.

However, one of the disadvantages of the constant amount replenishing methods as referred to above is that it is impossible to cope with the variation of toner consumption for each copy paper size. In other words, even with respect to the same image density, if the copy paper sheet size is increased, the toner consumption is also increased by that extent, while on the contrary, upon reduction of the copy paper sheet size, the toner consumption is also decreased. Thus, if a large amount of copying is effected by copy paper sheets in large size or small size in a state not on the average, the state in which the balancing between the replenishing amount and the consumption is largely lost continues for a long period, thus resulting in a deviation of the toner concentration within the developing apparatus to a large extent.

In order to solve the problem as described above, there has also been proposed another method in which, by preliminarily setting the toner replenishing amount equal to the toner consumption in the case where copy is taken at the average image density for each size of the copy paper sheets, by copy paper sheet size is detected during the copying so as to replenish toner in the amount corresponding to said size. By the above practice, the problem related to the deviation of toner due to variation of the copy paper sheet size has been solved.

Another disadvantage inherent in the constant amount replenishing method is that said method can not cope with the variation of the toner consumption following the variation of the image density. In other words, deviation of the toner concentration within the developing apparatus occurs when a large amount of copying is continuously taken in different image densities with respect to the average image density referred to earlier.

For solving the above problem, there has been conventionally proposed a method in which, with a reference toner image formed on the surface of a photosensitive member, the toner replenishing amount is varied so as to correspond to the toner concentration within the developing apparatus as detected through detection of the density of said toner image, for example, in Japanese Patent Laid-Open Application Tokkaisho No. 58-190966.

In the above practice employing the reference toner image, there is a possibility that an erronous toner replenishment is effected of a sensor for detecting the reference toner image becomes faulty, and therefore, it is required that the sensor is arranged to be checked for any fault at all times.

Meanwhile, when the toner to be replenished has run out in the toner replenishing means, the toner replenishment can not be effected, and therefore, in the conventional arrangements, an exclusive sensor has been provided for the detection of the state for "toner empty".

SUMMARY OF THE INVENTION

Accordingly, an essential object of the present invention is to provide a developing apparatus provided with a toner replenishing arrangement, which is capable of maintaining concentration of the developing material constant, irrespective of large size or small size of copy sheets to be used for recording.

Another object of the present invention is to provide a developing apparatus of the above described type, in which concentration of the developing material is not varied depending on densities of images to be recorded.

A further object of the present invention is to provide a developing apparatus of the above described type, which is capable of detecting troubles of the apparatus without necessity for providing an exclusive sensor therefor.

Still another object of the present invention is to provide a developing apparatus of the above described type, which is capable of detecting the state of "toner empty" without provision of a sensor exclusive for the purpose.

Still further object of the present invention is to provide a developing apparatus of the above described type, which is capable of detecting troubles of a developing material replenishing means without providing an exclusive sensor therefor.

In accomplishing thses and other objects, according to one preferred embodiment of the present invention, there is provided a developing apparatus for use in an image recording device of electrophotographic system, which includes:

a developing means containing a developing material composed of toner and carrier for developing an electrostatic latent image formed on a photosensitive member by the toner;

a concentration detecting means for detecting concentration of the toner for the developing material wihtin said developing means;

a toner accommodating means for accommodating toner to be supplied to said developing means;

a replenishing means for replenishing toner from said toner accommodating means to said developing means, with the toner replenishing amount of said replenishing means being adapted to be variable;

a control means which determines the toner replenishing amount by said replenishing means per each one recording cycle for causing said replenishing means to function; and a trouble detecting means for detecting troubles of apparatus according to the toner replenishing amount to be determined by said control means.

More specifically, in one aspect of the present invention, there is provided a toner replenishing arrangement which includes a replenishing means for replenishing a specified amount of toner into a developing apparatus, a concentration detecting means for detecting toner concentration within the developing apparatus, a paper size detecting means for detecting sizes of copy paper sheets, a replenishing amount control means for designating the toner replenishing amount by said replenishing means within a predetermined range so as to correspond to the toner concentration and the paper size detected by said concentration detecting means, and a toner empty detecting means which judges that the toner to be replenished has been used up when a state in which the toner replenishing amount designated by said replenishing amount control means is the maximum replenishing amount, has continued by a predetermined number of times.

In another aspect of the present invention, there is also provided a toner replenishing arrangement which includes a replenishing means for replenishing a specified amount of toner into a developing apparatus, a concentration detecting means for detecting toner concentration within the developing apparatus, a paper size detecting means for detecting sizes of copy paper sheets, a replenishing amount control means for designating the toner replenishing amount by said replenishing means within a predetermined range so as to correspond to the toner concentration and the paper size detected by said concentration detecting means, and a fault detecting means which judges that said concentration detecting means is faulty when a state in which the toner replenishing amount designated by said replenishing amount control means is the minimum replenishing amount, has continued by a predetermined number of times.

The toner replenishing amount by the replenishing amount control means is to be designated within a predetermined range about a reference value as a center. Accordingly, the toner replenishing amount is normally varied with respect to the reference value as the center, and it is rare that the state in which the toner replenishing amount is at the maximum or minimum value, is kept for a long period of time. Therefore, it is arranged to judge as "toner empty" or "sensor fault" if the state at the maximum value or minimum value is continued for a predetermined period of time.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
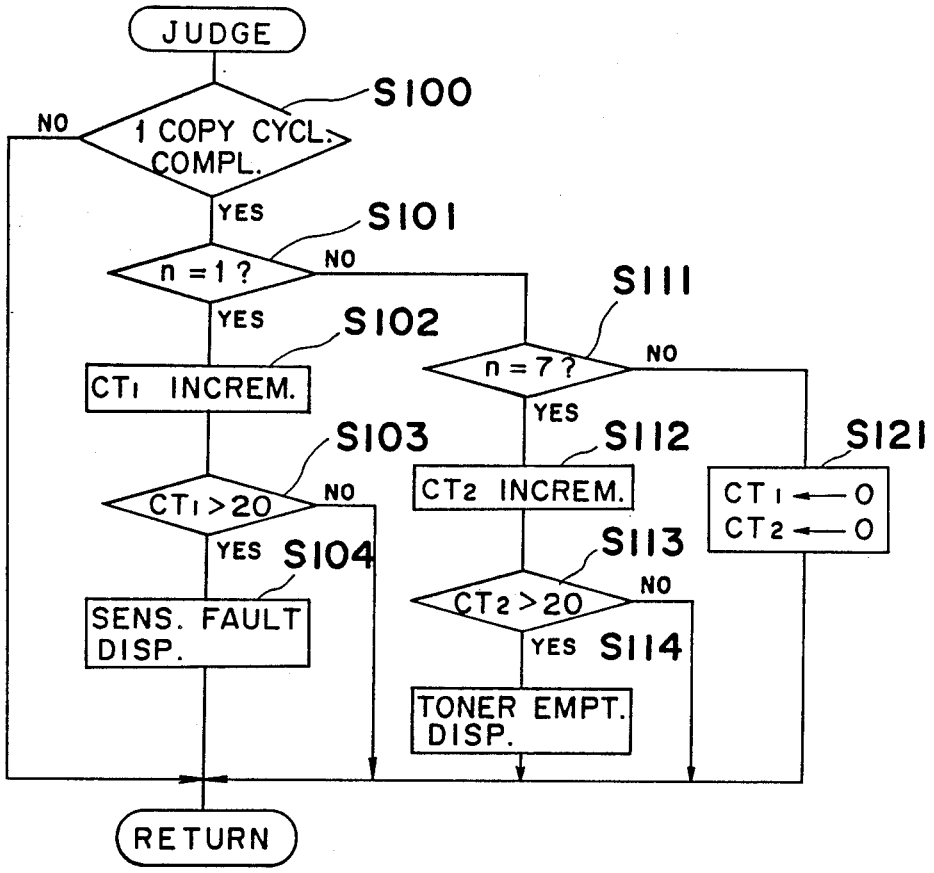
FIG. 1 is a flow-chart for explaining "toner empty" detection and "sensor fault" detection in a toner replenishing arrangement according to the present invention.

Before the description of the present invention proceeds, it is to be noted that like parts are designated by like reference numerals throughout the accompanying drawings.

Figure 2:
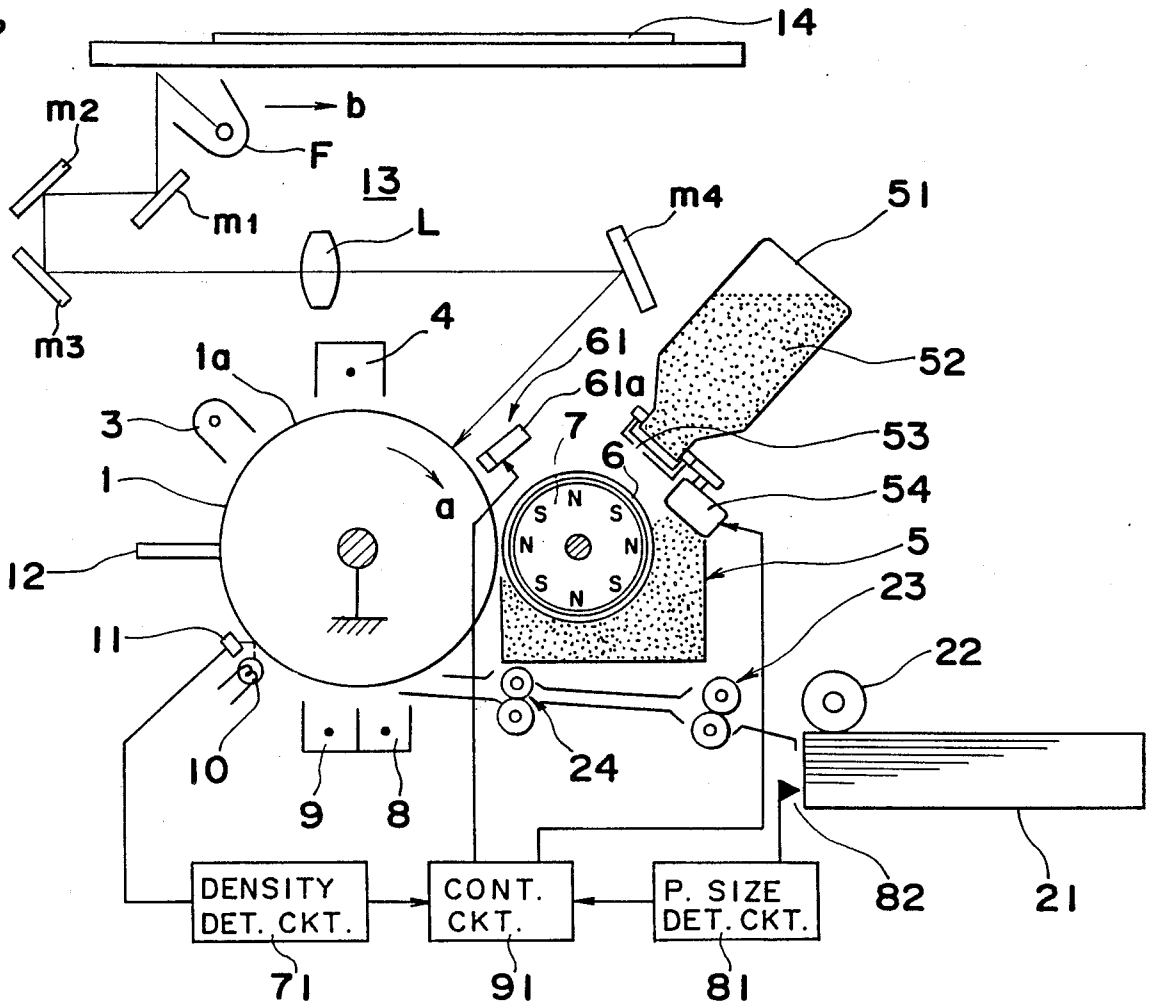
FIG. 2 a schematic diagram showing general construction of an electrophotographic copying apparatus to which the developing apparatus provided with the toner replenishing arrangement according to one preferred embodiment of the present invention may be applied.

Referring now to the drawings, there is shown in FIG. 2 an electrophotographic copying apparatus to which a developing apparatus provided with a toner replenishing arrangement according to one preferred embodiment of the present invention is applied. In this copying apparatus, the electrophotographic process in the known practice is employed.

In FIG. 2, the electrophotographic copying apparatus generally includes a photosensitive or photoreceptor drum 1 having a photosensitive layer 1*a* on its outer peripheral surface and rotatably disposed generally at a central portion of the apparatus for rotation in a direction indicated by an arrow a, and a series of processing devices such as an eraser lamp 3, a corona charger 4, a developing apparatus 5, a transfer DC charger 8, a separation AC charger 9, a reflection type photosensor for a density measuring device (to be described later) having a light emitting element 10 and a light receiving element 11 for detecting reflection density of a reference image, and a cleaning blade 12, etc., which are sequentially disposed around the photoreceptor drum 1 as illustrated.

An image projecting device 13 provided above the photoreceptor drum 1 and including a light source F, reflecting mirrors m1 to m4 and a lens L for directing an image of an original document (not particularly shown) placed on a transparent original document platform 14 onto the photoconductive surface 1*a* of the photoreceptor drum 1, is arranged to scan the original document on the platform 14 in the scanning direction (indicated by an arrow b) in synchronization with rotation of the photoreceptor drum for projecting the reflected light of the original document onto the photosensitive surface 1*a* of the drum 1, thereby to form thereon an electrostatic latent image of the original document.

The developing apparatus 5 of a magnetic brush developing system is provided with a developing sleeve 6 in which a magnet roller 7 is incorporated, and is arranged to develop the electrostatic latent image formed on the photosensitive surface 1*a* of the photoreceptor drum 1 by a magnetic developing material transported over the developing sleeve 6 through rotation of the magnet roller 7 and/or developing sleeve 6. For the developing material, a mixture of insulative toner and magnetic carrier is employed, and the insulative toner is consumed for the developing. Accordingly, it is necessary to replenish the developing apparatus 5 with the insulative toner corresponding in amount to the consumption. The insulative toner 52 for the replenishment as referred to above is preliminarily accommodated in a toner bottle 51 mounted above the developing apparatus 5 within the copying apparatus, and is adapted to be properly fed into the developing apparatus 5 through a replenishing window 53 provided at a mouth of the toner bottle 51 and associated with a toner replenishing motor 54 for rotation. Here, since the toner replenishing amount is determined based on a rotating time of the replenishing window 53, it is arranged to adjust the toner replenishing amount through variation of the rotating time by the toner replenishing motor 54. The toner bottle 51 is detachably mounted on the copying apparatus main body, and addition of the replenishing toner is effected by detaching the empty toner bottle 51 and loading a fresh bottle thereon.

In the present embodiment, toner concentration within the developing apparatus 5 is indirectly measured by forming a reference pattern on the surface 1*a* of the photoreceptor drum 1 so as to be developed by the developing apparatus 5, and detecting the density of the reference pattern thus developed. There is provided a reference pattern preparinng device 61 having an inter-image eraser 61*a* constituted by LEDs and arranged to de-energize the LED at the pattern forming portion during formation of the pattern so as to form a latent image of the reference pattern on the surface 1*a* of the photoreceptor drum 1, whereby during developing, toner is also attracted onto the electrostatic latent image of the reference pattern and thus, the reference pattern is developed into a visible image. It is to be noted that such pattern is formed at a marginal region between images where the electrostatic latent image of the original document image is not formed.

The density measuring device includes the light emitting element 10 and light receiving element 11 for the reflection type photosensor referred to earlier and a density detecting circuit 71. Light emitted from the light emitting diode 10 is projected onto the pattern formed by the pattern preparing device 61, and the light reflected therefrom is received by the light receiving element 11. The density detecting circuit 71 detects, through employment of a comparator, the densities of the pattern based on levels of the reflected light.

Meanwhile, copy paper sheets in a stack accommodated within a paper cassette 21 are fed, one sheet by one sheet, by a paper feeding roller 22 and a pair of transport rollers 23 up to a set of timing rollers 24, and further fed therefrom, to the transfer charger 8 in synchronization with the image formation on the surface 1*a* of the photoreceptor drum 1, whereby the developed toner image on the photoconductor surface 1*a* is transferred onto the copy paper sheet so as to be subsequently fixed thereon by a fixing device (not shown).

Incidentally, in the vicinity of the cassette 21, a plurality of size detection switches 82 are provided as schematically shown in FIG. 2, and a paper size detecting circuit 81 coupled with the switches 82 judges the paper size based on signals from said switches.

Figure 3:
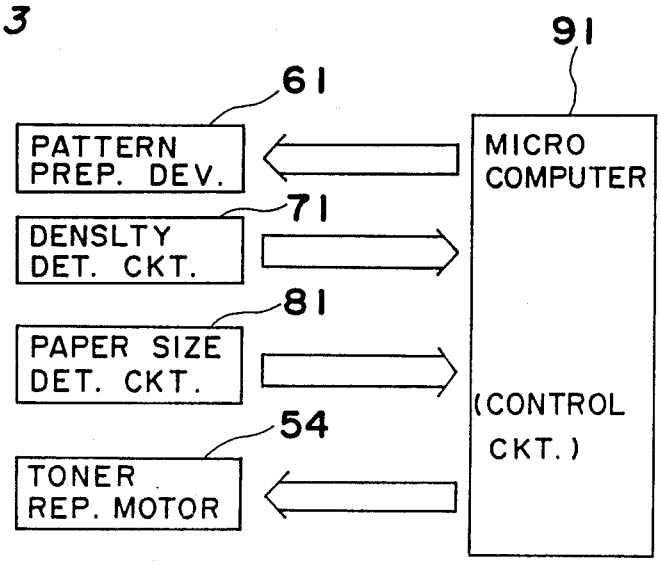
FIG. 3 is a block diagram for explaining construction of a control circuit employed in the arrangement of FIG. 2.

FIG. 3 shows a block diagram of a control circuit provided with a micro-computer 91. This micro-computer 91 lets the pattern preparing device 61 form the pattern, and determines the toner replenishing amount based on the result of measurement at the density detection circuit 71 and the size data from the paper size detecting device 81, and effects the replenishment of the predetermined amount of toner through control of the driving time for the toner replenishing motor 54. The micro-computer 91 also effects control of other image forming processings, but description thereof is abbreviated here for brevity.

It is to be noted that in the present embodiment, although the toner concentration within the developing apparatus 5 is detected by the density measurement of the reference pattern, it may be so modified that the toner concentration within the developing device 5 is directly detected.

Subsequently, the control method of the toner replenishment by the control circuit as shown in FIG. 3 will be described.

TABLE

| paper-size | Toner Replenishing Time | | | | | | |
|---|---|---|---|---|---|---|---|
| | replenishing rank n | | | | | | |
| m | 1 | 2 | 3 | 4 | 5 | 6 | 7 |
| 1:A6 | T(1.1) | T(1.2) | T(1.3) | T(1.4) | T(1.5) | T(1.6) | T(1.7) |
| 2:B6 | T(2.1) | T(2.2) | T(2.3) | T(2.4) | T(2.5) | T(2.6) | T(2.7) |
| 3:A5 | T(3.1) | T(3.2) | T(3.3) | T(3.4) | T(3.5) | T(3.6) | T(3.7) |
| 4:B5 | T(4.1) | T(4.2) | T(4.3) | T(4.4) | T(4.5) | T(4.6) | T(4.7) |
| 5:A4 | T(5.1) | T(5.2) | T(5.3) | T(5.4) | T(5.5) | T(5.6) | T(5.7) |
| 6:B4 | T(6.1) | T(6.2) | T(6.3) | T(6.4) | T(6.5) | T(6.6) | T(6.7) |
| 7:A3 | T(7.1) | T(7.2) | T(7.3) | T(7.4) | T(7.5) | T(7.6) | T(7.7) |

In the above Table showing the toner replenishing time, vertical rows show variations of replenishing time according to paper sizes, with the replenishing time being prolonged as the paper size increases (i.e., as the value for m becomes larger), while lateral lines represent the ranks of the replenishing time to be determined by the density of the pattern as detected and the replenishing time becomes longer as the value for n increases. Thus, by the paper size m for the vertical row, and the rank n for the lateral line, the replenishing time T(m, n) may be determined. By way of example, if the paper size is of A4 and the replenishing rank is 4, the replenishing time is at T (5, 4). The rank n for the replenishing time relates to variables from 1 to 7 to be determined on software, based on the results of the pattern density measurements through processing of the micro-computer to be described later, and serves as parameters for altering the toner replenishing amount stepwise. Here, the time when a central value is at n=4, represents the replenishing time for replenishing the same amount of toner as an average toner consumption, and during normal copying, the value is varied in the vicinity of n=4 as a center. Thereafter, it is very seldom that the mode in which the replenishing amount is the largest at the value n=7 continues for a long period of time. However, when no toner is present within the toner bottle 51, even if the replenishing motor 54 is driven for the toner replenishment, no replenishment is actually made, and therefore, the mode at n=7 will continue for a long period of time. Based on this principle, when the above mode continues for the long period of time, it may be judged as "toner empty" within the toner bottle 51.

similarly, it is quite seldom during normal copying, that the mode in which the replenishment becomes the smallest at n=1, continues for a long period of time. If such mode continues, it may be regarded as an erroneous detection due to soiling, etc. of the measuring device including the light emitting element 10, light receiving element 11. From this principle, if the mode for n=1 continues for a long period, it may be judged as a fault of the measuring device.

Figure 4:
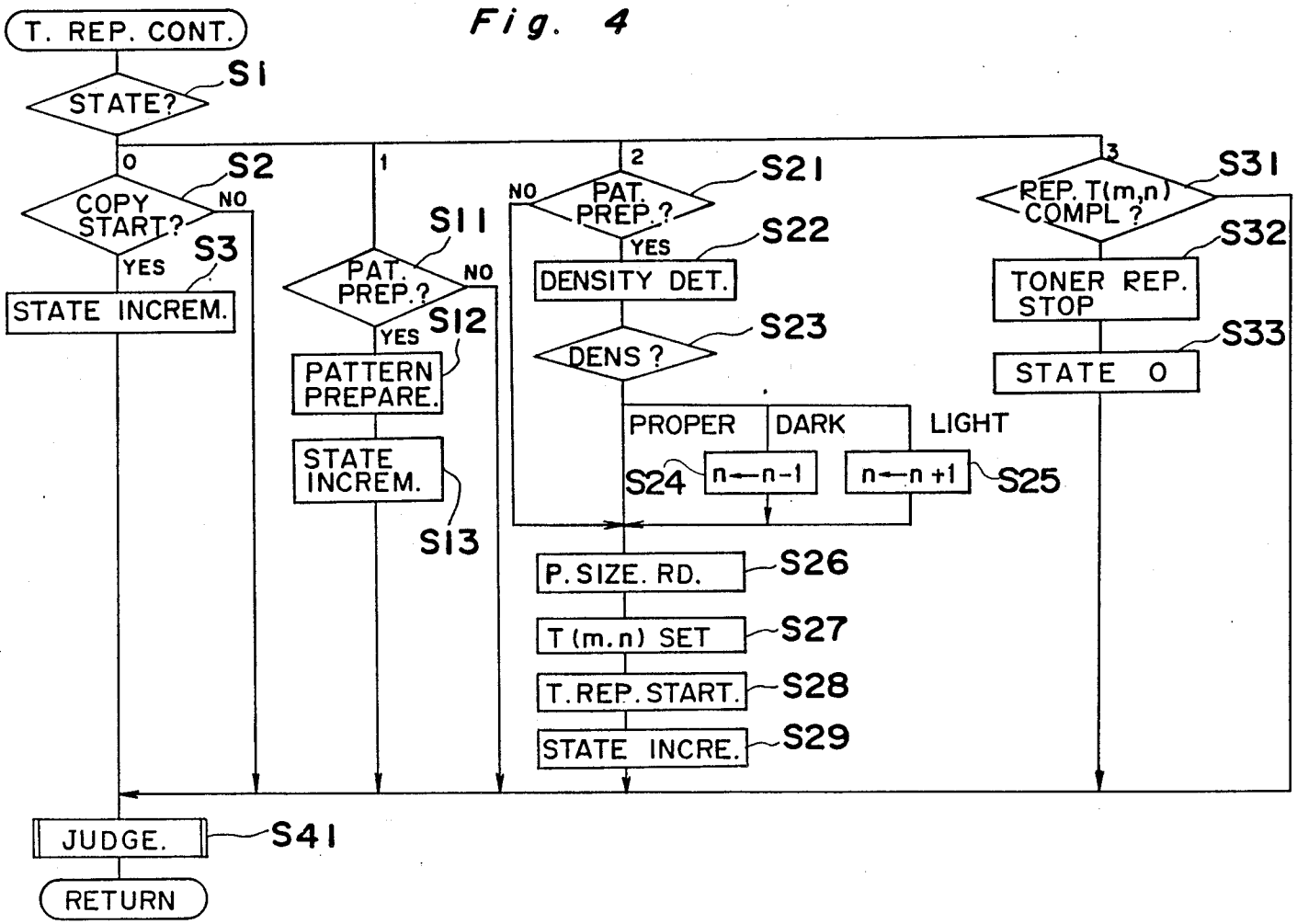
FIG. 4 is a flow-chart for explaining replenishing control in the toner replenishing arrangement of the present invention.

Reference is further made to a flow-chart of FIG. 4 showing processing procedures for the toner replenishing control referred to earlier, whereby the toner replenishment is effected per one copy cycle.

In the first place, branching is effected by the state K of the copy cycle (step S1). In the case where K=0, it is first checked whether or not copying is started (step S2), and upon depression of a print button, the state K is incremented (step S3).

In the case where the state K=1 at step S1, it is first checked whether or not preparation of the reference pattern is possible (step S11). When the pattern preparation becomes possible, i.e., upon completion of the process for the original document image formation, the pattern is formed (step S12), and the state K is incremented (step S13).

Meanwhile, in the case where the state K=2 at step S1, it is first judged whether or not the pattern has been prepared (step S21). If it has been prepared, the pattern thus prepared is measured for its density (step S22) for judgement as to whether the density is proper, dark or light (step S23). If the judgement is of "proper", the rank n is not altered, while, if the judgement is of "dark", the rank n is lowered by 1 (step S24), i.e., the toner replenishing time is reduced. On the other hand, in the case where the judgement is of "light", the rank n is raised by 1 so as to prolong the replenishing time (step S25). Subsequently, the paper size is detected (step S26) so as to determine the value m in the Table for the replenishing time. Then, from the values n and m thus obtained, the toner replenishing time T (m, n) is determined based on the Table for the replenishing time (step S27), and the toner replenishing is started by driving the toner replenishing motor 54 (step S28), and the state is incremented (step S29).

In the case where K=3 at step S1, it is first checked whether or not the replenishing time has been terminated (step S31), and if the replenishing time has been completed, toner replenishment is stopped by stopping the toner replenishing motor 54 (step S32), and the state K is returned to 0 (step S33).

Hereinafter, the sub-routine (step S41) for effecting judgements of detection for the "toner empty" and sensor fault will be explained.

FIG. 1 is a flow-chart specifically showing the processing at the judging sub-routine of step S41 in FIG. 4, and represents the flow of the detection for the "toner empty" and sensor fault.

Although a sensor is exclusively provided for the detection of "toner empty" in the conventional arrangements, the "toner empty" is detected by the processing of this flow-chart without provision of such a sensor, together with the fault detection due to soiling of the measuring device.

In the first place, at step S100, it is checked whether or not one copy cycle has been completed, and if completed, the procedure proceeds to step S101. Then, it is checked whether or not the rank n is 1 (step S101). If n=1, a counter CT1 defined in terms of the program is incremented (step S102). This counter CT1 is intended to count the continuing time (number of sheets to be copied) for the mode (n=1) of the least toner replenishing amount.

Subsequently, it is checked whether or not the counter CT1 is increased in its value above the set value (step S103). Here, the set value is of 20, and when the mode n=1 has been kept continuously for 21 sheets (CT1>20), it is judged that the measuring device is faulty, and the sensor fault is displayed for the operator (step S104).

Meanwhile, if the relation is not n=1 at step S101, it is checked whether or not n=7 (step S111). If n=7, a counter CT2 defined in terms of the program is incremented (step S112). This counter CT2 is intended to count the continuing time (number of sheets to be copied) for the mode (n=7) of the most toner replenishing amount. Then, it is checked whether or not the counter CT2 has become larger in its value than the set value (step S113). Here, the set value is of 20, and in the case where the mode for n=7 has continued for 21 sheets successively (CT2>20), the "toner empty" is displayed (step S114).

Subsequently, if the relation is not n=1 at step S111, this means the case where the relation is neither n=1 nor n=7, and the counters CT1 and CT2 for the respective modes are reset (step S121) to prepare for the next toner replenishment.

It is to be noted here that, in the foregoing embodiment, although the present invention has been mainly described as applied to a copying apparatus of electrophotographic system, the concept of the present invention is not limited in its application to such a copying apparatus alone, but may be readily applied to printers of electrophotographic system such as a laser beam printer, LED printer and the like.

As is clear from the foregoing description, according to the toner replenishing arrangement of the present invention, it is possible to detect the "toner empty" state without provision of a sensor exclusive to detection of the "toner empty", and is also possible to detect any faults due to soiling, etc. of the image density detecting means or toner density detecting means.

Although the present invention has been fully described in connection wiht the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A developing apparatus for use in image recording device of an electrophotographic system, which comprises:

a developing means containing a developing material composed of toner and carrier for developing an electrostatic latent image formed on a photosensitive member;

a concentration detecting means for detecting concentration of the toner in the developing material within said developing means;

a toner accommodating means for accommodating toner to be supplied to said developing means;

a replenishing means for replenishing toner from said toner accommodating means to said developing means, with the toner replenishing amount of said replenishing means being adapted to be variable;

a control means which determines the toner replenishing amount to be supplied by said replenishing means per each one recording cycle for causing said replenishing means to function; and a trouble detecting means for detecting trouble of the apparatus based on the toner replenishing amount as determined by said control means.

2. A developing apparatus as claimed in claim 1, wherein said trouble detecting means detects that the toner within said toner accommodating means is empty when the toner replenishing amount to be determined by said control means is at a maximum for a predetermined period of time.

3. A developing apparatus as claimed in claim 1, wherein said trouble detecting means detects the trouble of said toner concentration detecting means when the toner replenishing amount to be determined by said control means is at a minimum for a predetermined period of time.

4. A developing apparatus as claimed in claim 1, wherein said concentration detecting means further includes:

a pattern preparing means for forming a latent image of a reference pattern on the photosensitive member; and a pattern density detecting means for detecting density of the reference pattern developed by said developing means.

5. A developing apparatus as claimed in claim 1, wherein said trouble detecting means detects the trouble of said replenishing means when replenishment occurs when the toner replenishing amount to be determined by said control means is at a maximum for a predetermined period of time.

6. A developing apparatus for use in an image recording device of an electrophotographic system, which comprises:

a developing means containing a developing material composed of toner and carrier for developing an electrostatic latent image formed on a photosensitive member;

a concentration detecting means for detecting concentration of the toner in the developing material within said developing means;

a replenishing means for replenishing toner to said developing means, with the toner replenishing amount of said replenishing means being adapted to be variable, said replenishing means having a toner accommodating means for accommodating toner for the replenishment;

a control means which determines the toner replenishing amount to be supplied by said replenishing means according to the toner concentration detected by said concentration detecting means for causing said replenishing means to function at predetermined timing; and a trouble detecting means for detecting trouble of the apparatus according to the toner replenishing amount to be determined by said control means.

7. A developing apparatus as claimed in claim 6, wherein said trouble detecting means detects when the toner replenishing amount to be determined by said control means is at a maximum for a predetermined period of time.

8. A developing apparatus as claimed in claim 7, wherein the trouble of said replenishing means is the state of toner empty of said accommodating means.

9. A developing apparatus as claimed in claim 5, wherein said trouble detecting means detects the trouble of said toner concentration detecting means when the toner replenishing amount to be determined by said control means is at a minimum for a predetermined period of time.

10. A developing apparatus as claimed in claim 6, wherein said concentration detecting means further includes:

means for forming a latent image of a reference pattern on the photosensitive member; and a pattern density detecting means for detecting density of the reference pattern developed by said developing means.

11. A developing apparatus for use in an image recording device of an electrophotographic system, which comprises:

a developing means containing a developing material composed of toner and carrier for developing an electrostatic latent image formed on a photosensitive surface;

a concentration detecting means for detecting concentration of the toner in the developing material within said developing means;

a toner accommodating means for accommodating toner to be supplied to said developing means;

a size detecting means for detecting sizes of sheets to be used for the recording;

a replenishing means for replenishing toner from said toner accommodating means to said developing means, with the toner replenishing amount of said replenishing means being adapted to be variable;

a control means which determines the toner replenishing amount to be supplied by said replenishing means based on the toner concentrations detected by said concentration detecting means and sheet sizes detected by said size detecting means so as to control for causing said replenishing means to function; and a trouble detecting means for detecting trouble of the apparatus according to the toner replenishing amount to be determined by said control means.

12. A developing apparatus as claimed in claim 11, wherein said trouble detecting means detects the trouble of said replenishing means when replenishment occurs when the toner replenishing amount to be determined by said control means is at a maximum for a predetermined period of time.

13. A developing apparatus as claimed in claim 11, wherein said trouble detecting means detects that the toner within said toner accommodating means is empty when the toner replenishing amount to be determined by said control means is at a maximum for a predetermined period of time.

14. A developing apparatus as claimed in claim 11, wherein said trouble detecting means detects the trouble of said toner concentration detecting means when the toner replenishing amount to be determined by said control means is at a minimum for a predetermined period of time.

15. A developing apparatus as claimed in claim 11, wherein said concentration detecting means further includes:

means for forming a latent image of a reference pattern on the photosensitive member; and a pattern density detecting means for detecting density of the reference pattern developed by said developing means.

16. A developing apparatus for use in an image recording device of an electrophotographic system, which comprises:

a developing means containing a developing material composed of toner and carrier for developing an electrostatic latent image formed on a photosensitive surface;

a concentration detecting means for detecting concentration of the toner in the developing material within said developing means;

a toner accommodating means for accommodating toner to be supplied to said developing means;

a size detecting means for detecting sizes of sheets to be used for the recording;

a replenishing means for replenishing toner from said toner accommodating means to said developing means per each recording cycle, with the toner replenishing amount of said replenishing means being adapted to be variable;

a control means which determines the toner replenishing amount to be supplied according to the sheet size detected by said size detecting means, by the toner concentration detected by said concentration detecting means, and causes said replenishing means to function so as to replenish the toner in the amount thus corrected by the developing means; and a trouble detecting means for detecting troubles of the apparatus based on the toner replenishing amount as corrected by said control means.

17. A developing apparatus as claimed in claim 16, wherein said trouble detecting means detects the trouble of said replenishing means when a replenishing amount to be determined by said control means is at a maximum for a predetermined period of time.

18. A developing apparatus as claimed in claim 16, wherein said trouble detecting means detects that the toner within said toner accommodating means is empty when the toner replenishing amount to be determined by said control means is at a maximum for a predetermined period of time.

19. A developing apparatus as claimed in claim 16, wherein said trouble detecting means detects the trouble of said toner concentration detecting means when the toner replenishing amount to be determined by said control means is at a minimum for a predetermined period of time.

20. A developing apparatus as claimed in claim 16, wherein said concentration detecting means further includes:

means for forming a latent image of a reference pattern on the photosensitive member; and a pattern density detecting means for detecting density of the reference pattern developed by said developing means.

21. A developing apparatus for use in an image recording device of electrophotographic system, which comprises:

a developing means containing a developing material composed of toner and carrier for developing an electrostatic latent image formed on a photosensitive member by the toner;

a concentration detecting means for detecting toner concentration by the developing material within said developing means;

a toner accommodating means for accommodating toner to be supplied to said developing means;

a size detecting means for detecting sizes of sheets to be used for the recording;

a replenishing means for replenishing toner from said toner accommodating means to said developing means, with the toner replenishing amount being predetermined into a plurality of ranks; and a control means for determining a particular one of said ranks corresponding to the toner replenishing amount by said replenishing means based on the toner concentrations detected by said concentration detecting means and sheet sizes detected by said size detecting means.

22. A developing apparatus for use in an image recording device of electrophotographic system, which comprises:

a developing means containing a developing material composed of toner and carrier for developing an electrostatic latent image formed on a photosensitive member;

a concentration detecting means for detecting toner concentration of the toner in the developing material within said developing means;

a toner accommodating means for accommodating toner to be supplied to said developing means;

a size detecting means for detecting sizes of sheets to be used for the recording;

a replenishing means for replenishing toner from said toner accommodating means to said developing means, with the toner replenishing amount being predetermined into a plurality of ranks;

a control means for determining a particular one of said ranks corresponding to the toner replenishing amount to be supplied by said replenishing means based on the toner concentrations detected by said concentration detecting means and sheet sizes detected by said size detecting means; and a trouble detecting means for detecting trouble of the apparatus according to the toner replenishing amount to be determined by said control means.

23. A developing apparatus as claimed in claim 22, wherein said trouble detecting means detects the trouble of said replenishing means when the toner replenishing amount to be determined by said control means is at a maximum for a predetermined period of time.

24. A developing apparatus as claimed in claim 22, wherein said trouble detecting means detects that the toner within said toner accommodating means is empty when the toner replenishing amount to be determined by said control means is at a maximum for a predetermined period of time.

25. A developing apparatus as claimed in claim 22, wherein said trouble detecting means detects the trouble of said toner concentration detecting means when the toner replenishing amount to be determined by said control means is at a minimum for a predetermined period of time.

26. A developing apparatus as claimed in claim 22, wherein said concentration detecting means further includes:

means for forming a latent image of a reference pattern on the photosensitive member; and a pattern density detecting means for detecting density of the reference pattern developed by said developing means.

27. A developing apparatus for use in an image recording device of electrophotographic system, which comprises:

a developing means containing a developing material composed of toner and carrier for developing an electrostatic latent image formed on a photosensitive member;

a concentration detecting means for detecting toner concentration of the toner in the developing material within said developing means;

a toner accommodating means for accommodating toner to be supplied to said developing means;

a size detecting means for detecting sizes of sheets to be used for the recording;

a replenishing means for replenishing toner from said toner accommodating means to said developing means said replenishing means being capable of replenishing plural different amounts of toner where each amount is classified in different ranks; and a control means for including a matrix table for defining a specific toner replenishing amount according to said plurality of sheet sizes and said plural ranks of the replenishing amounts, said control means determining said specific toner replenishing amount to be supplied from the replenishing amount of toner corresponding to previously determining rank based on the toner concentration detected by said concentration detecting means and the sheet size detected by said size detecting means.

* * * * *